US008075409B1

(12) United States Patent
Zivkovic

(10) Patent No.: US 8,075,409 B1
(45) Date of Patent: Dec. 13, 2011

(54) FENCING STRIP

(75) Inventor: Branimir Zivkovic, Wellesley Hills, MA (US)

(73) Assignee: Branimir Zivkovic, Wellesley, MA (US)

( * ) Notice: Subject to any disclaimer, the term of this patent is extended or adjusted under 35 U.S.C. 154(b) by 842 days.

(21) Appl. No.: 12/029,407

(22) Filed: Feb. 11, 2008

(51) Int. Cl.
*A63F 9/24* (2006.01)
*G06F 19/00* (2006.01)

(52) U.S. Cl. ..... 463/47; 463/47.1; 482/12; 362/153; 273/309; 14/71.3

(58) Field of Classification Search ..... 463/47.1, 463/47.2; 482/12, 83, 90; 273/309; 340/323 R
See application file for complete search history.

(56) References Cited

U.S. PATENT DOCUMENTS 3,920,242 A * 11/1975 Reith et al. ..... 463/47.1
4,030,731 A * 6/1977 Delcayre ..... 463/47.1
4,271,622 A * 6/1981 Tippmann et al. ..... 40/606.03
5,836,853 A * 11/1998 Marciano ..... 482/12
6,669,601 B2 * 12/2003 Marciano ..... 482/12
2007/0263380 A1 * 11/2007 Hamar et al. ..... 362/153
2009/0020953 A1 * 1/2009 Hallsten ..... 273/309
2010/0146719 A1 * 6/2010 Swessel et al. ..... 14/71.3

* cited by examiner

*Primary Examiner* — Paul A. D'Agostino
(74) *Attorney, Agent, or Firm* — William A. Loginov, Esq.; Loginov & Associates, PLLC

(57) ABSTRACT

A fencing strip includes a plurality of light assemblies, in communication with the scoring controller and console. The light assemblies are embedded at predetermined locations within the fencing strip to project at least two different types of light through the perforations, indicating which fencer has scored. The light assemblies are located at spaced-apart positions along the overall length of the strip which includes an electrically conductive top surface that completes a circuit when a fencer's conductive blade contacts the strip surface (a non-scoring touch). The conductive top surface is perforated to maintain a continuous contact surface that can differentiate a non-scoring touch from a fencer's blade, via an interconnection between the top surface and scoring console. The perforations allow for transmission of light therethrough. A plurality of ramped placards extend outwardly from the overhang of the elevated subsurface and the adjacent floor in a downwardly angled direction.

15 Claims, 6 Drawing Sheets

FENCING STRIP

FIELD OF THE INVENTION

This invention relates to equipment used in the sport of fencing, and more particularly to electrically conductive fencing strips used to record scores in competition.

BACKGROUND OF THE INVENTION

Fencing is an ancient and highly regarded art form. It is a highly competitive and strenuous sport for two contestants (fencers). As shown, by way of example in FIG. 1, a fencing competition involves two contestants (fencers) 110, 120 wearing appropriate protective clothing 112, 114 and face masks 114, 124, respectively. Each contestant 110, 120 uses a blade 116, 126, that is appropriate to the particular type of fencing (foil, epée, etc.).

In competition, fencers are judged by a referee 131 who monitors the fencer's activities as each competitor attempts to score touches on key areas of the other one's body with his or her blade. In competition, and in various types of fencing, the fencers employ blades having electrical contacts on their tips that respond to a touch (for example, epee and foil). Other blades, such as saber, may employ a conductive blade surface. The fencer may also employ special garments 112, 122 that include an electrically conductive material (for use in saber, for example). The material is electrically connected to a body cord (not shown). This body cord is also connected to the fencer's weapon.

The body cord extends inside the fencer's sleeve to a connection point inside the guard of the weapon. The body cord extends down the fencer's back to a connection with wires 118, 128, which extend from each respective fencer as shown. Touches by each fencer 110, 120 on various parts of the opponent's body transmit signals through respective wires 118, 128. The wires 118, 128 are each connected to a respective spring-wound reel (not shown) located at each opposing end of the strip, beyond the boundary lines of competition. These reels take up and pay out each wire 118, 128 while maintaining tautness as the fencers move up and down an elongated platform knows as a fencing strip 130, and are connected to the main electronic scoring device/console (described below).

When constructed from aluminum (or another metallic) sheet, the fencing strip 130 includes an exposed top surface 132 that is electrically conductive. It is often constructed from aluminum sheet that may or may not include perforations or other structures thereon. The fencing strip is constructed in segments that are joined at joint lines 134 for easy storage and subsequent assembly during a match. Appropriate mechanical fasteners and connectors can be used to join the segments together. Sometimes, the segments are elevated on a set of lengthwise stringers 136.

The touch signals from each fencer are transmitted through the reel wires 118, 128 via a connecting cable system 150 to a central scoring console 160. The scoring console 160 may include a time clock 162 and a pair of score pylons 164 and 166. The pylons 164, 166 correspond to each fencer's scoring activities. In one embodiment, each pylon includes a discrete colored light 170 (for example, a red light on one pylon and a green light on the other pylon) to make it easier for the referee 131 and audience to identify which contestant scored a touch. An alphanumeric score window 172 may also be displayed on each pylon 164, 166, indicating each fencer's current score.

The top plate surface 132 is conductive because the strip generally represents an area in which no score is given in response to a touch. Thus, the entire surface of the strip is conductive and provides a ground plane connected to the reels. When a blade conductively contacts the strip surface during competition, the control system in the console 160 recognizes the touch as one with the strip and registers no score. Thus, it is important to be able to differentiate touches that simply contact the strip. The conductive surface in combination with an interconnection to scoring console enables such differentiation.

Because the rules of fencing are fairly sophisticated, the referee cannot simply rely upon the scoring console 160 to determine the outcome of a match. Rather, he or she must also pay constant attention to the fencer's movements to ensure that all touches have been properly scored and that the fencer has stayed with the bounds of the strip at all times.

Since a fully constructed fencing strip may extend at least 17 meters, the referee must move constantly with the back and forth over a reasonably long distance to closely track the movement of the (often quickly moving) fencers. As the fencers move to either respective end of the strip 130, the referee is now faced with a fairly long-distance view of the console 160. As such the referee must continually divide his or her attention between the fencers in front of him or her, and the more-distant, and off-angle, scoring console 160. In short, the referee must constantly turn his or her head back-and-forth, and simultaneously readjust his or her focus to keep up with the match. Only through this constant head-turning can the referee keep an eye on the score, while at the same time continually returning his or her attention to the fencers.

Accordingly, it is desirable to provide a system that enables a referee (and audience) to keep his or her eyes generally on both the fencers and the score at the same time, regardless of where the fencers are positioned along the fencing strip. It is also desirable to provide improvements to a fencing strip that better utilize the available space and possibly smooth the transition between the raised stringers (that may be needed in the strip's design) and the floor.

SUMMARY OF THE INVENTION

This invention overcomes the disadvantages of the prior art by providing a fencing strip that includes a plurality of light assemblies, in communication with the scoring controller and console. The light assemblies are embedded at predetermined locations within the fencing strip so as to project at least two different types of light through the perforations, thereby indicating which fencer has made a score. The light assemblies are located at spaced-apart positions along the overall length of the strip so that a referee need not constantly shift his or her gaze excessively away from the fencers'activity while attempting to read the current score on the console. In an illustrative embodiment, the strip includes an electrically conductive top surface that completes a circuit when a fencer's conductive blade contacts the strip surface (a non-scoring touch). The conductive top surface is perforated so as to maintain a continuous contact surface that can differentiate a non-scoring touch from a fencer's blade, via an interconnection between the top surface and the scoring console. The perforations allow for transmission of light therethrough without disrupting continuous contact.

In an illustrative embodiment, each of the light assemblies is provided in a respective enclosure or bucket that is mounted below the subsurface and the conductive perforated top surface. The subsurface (often comprising a fibrous material, such as melamine or fiberboard) can be mounted on stringers so as to be suspended above the floor, thereby providing clearance for the light assembly buckets. The buckets are mounted in slots formed through the subsurface. The dimensions of the slots are sized and arranged so that they do not excessively weaken the conductive top surface. Thus, they can be stood-upon without risk of damage. The light assemblies are located at key positions along the length of the strip, and are positioned at each of opposing widthwise edges for easy viewing on either side of the strip. The widthwise edges of the subsurface and conductive top surface tends to overhang the adjacent stringers slightly. This enables the placement of a plurality of ramped placards/panels that extend outwardly from the overhang of the elevated subsurface and the adjacent floor in a downwardly angled direction. Each of the placards/panels can include advertisements, logos or other information. The central fencing strip and the surrounding placards/panels are provided as segments that maybe locked together using a variety of different, conventional locking mechanisms. In one example, locks are provided between each subsurface panel on the outer edges of each adjacent subsurface edge. The conductive top surface can be electrically tied together between segments using a variety of conventional connecting devices.

BRIEF DESCRIPTION OF THE DRAWINGS

The invention description below refers to the accompanying drawings, of which.

DETAILED DESCRIPTION

Figure 1:
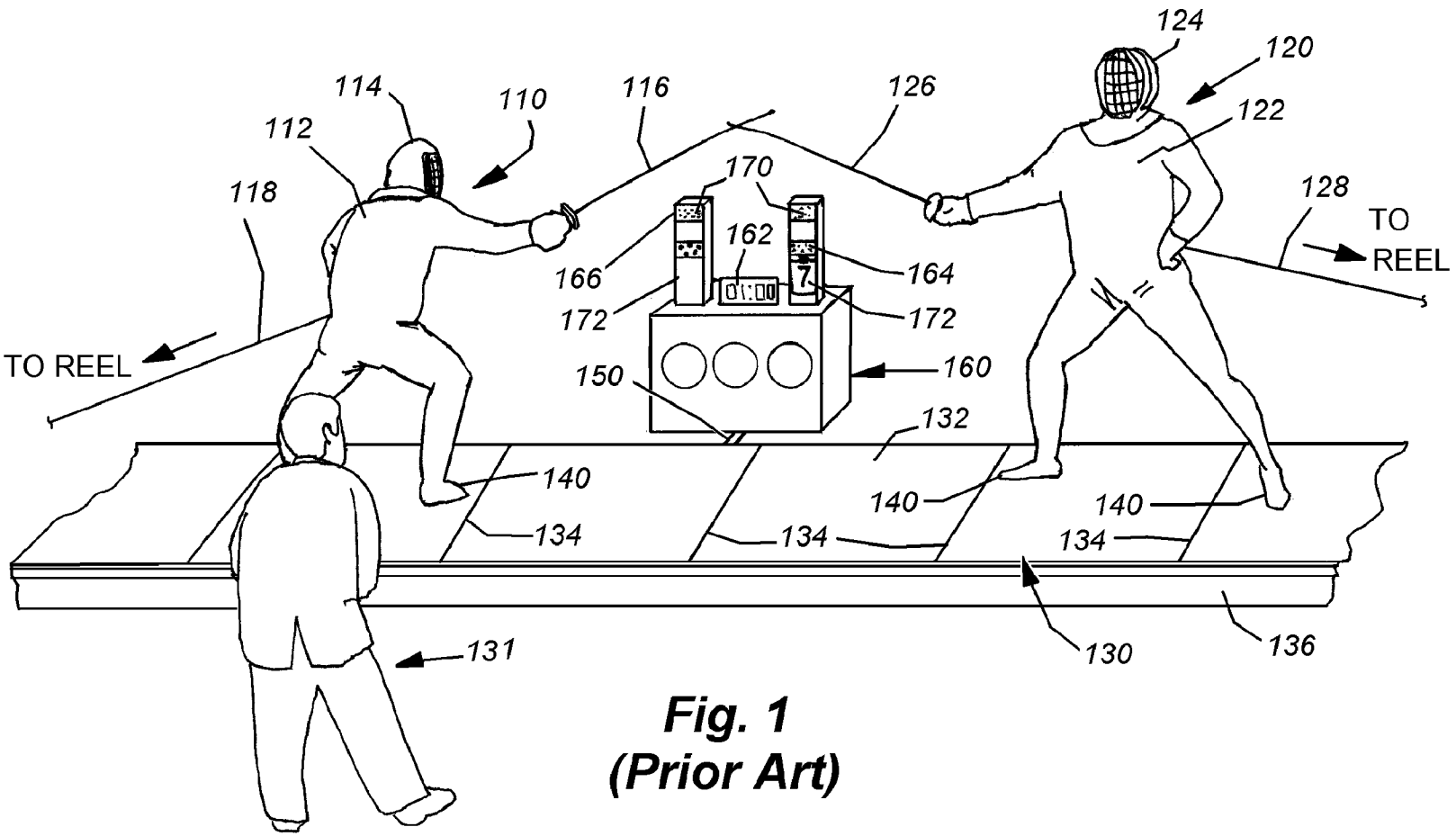
Fig. 1 (Prior Art)
FIG. 1, already described, is a partial perspective view of a fencing strip according to the prior art, which enables electronic scoring of competition through an electronic scoring console, and showing a pair of fencers engaged in a match with a referee observing.
Figure 2:
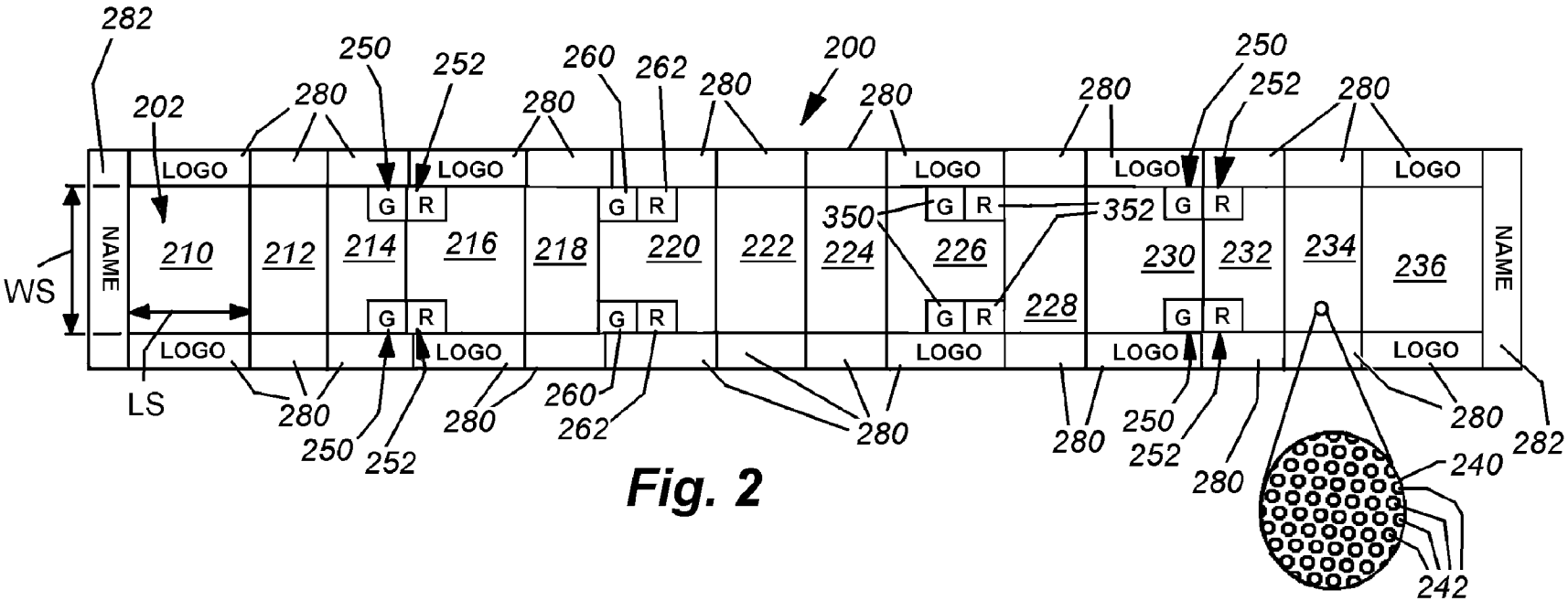
FIG. 2 is a plan view of a full-length, assembled fencing strip having integrated, embedded scoring light assemblies mounted on various segments along the length of the strip, and optional logo/information-containing panels/placards according to an illustrative embodiment of this invention.

A fencing strip according to an embodiment invention is shown in FIG. 2. The interior portion of the strip 202 (the flat portion that is stood upon) includes fourteen segments 210, 212, 214 216, 218, 220, 222, 224, 226, 228, 230, 232, 234 and 236. These segments are panels of approximately similar size and shape. Each panel has a length LS of approximately 122 centimeters and a width WS of approximately 151 centimeters. Note that these segment dimensions are exemplary and the size of individual strip segments in all dimensions can vary significantly. Likewise, the number of segments used to construct the fencing strip 200 is highly variable—thus, partially dictating the length of individual strip segments in the assembly. In this example, the total length of the inner portion of the strip (defined generally by the supporting subsurface covered by the conductive top surface) 202 is approximately 17 meters. However, depending upon the guidelines of the particular competition (e.g. world championship, Olympic, national championship, etc.) the overall length and width of the interior strip 202 is highly variable. Thus, typical length of the strip interior 202 varies from approximately 14 to 18 meters and width varies form approximately 1.5 to 2 meters.

In the illustrative embodiment, the top surface comprises a sheet of perforated aluminum alloy having a thickness of approximately 3 millimeters. These perforations are shown in further detail in the magnified window 240 of FIG. 2. The depicted perforations 242 are between approximately 1 millimeter and 5 millimeters in diameter. However, other perforation dimensions are expressly contemplated. The adjacent perforations 242 are separated by a minimum spacing distance of approximately 2 millimeters to 4 millimeters. The underlying subsurface (described further below) comprises a 1.6 centimeter thick particle or fiberboard sheet material, such as commercially available melamine laminate. Appropriate En Garde lines, 2-meter lines, and other regulation markings can be painted or applied along the top surface of the strip on appropriate segments thereof. Segments are designed to assemble together using any acceptable securing mechanism including screwed-down clamps that run between each of the two subsurface pieces at their joint (see below).

Figure 3:
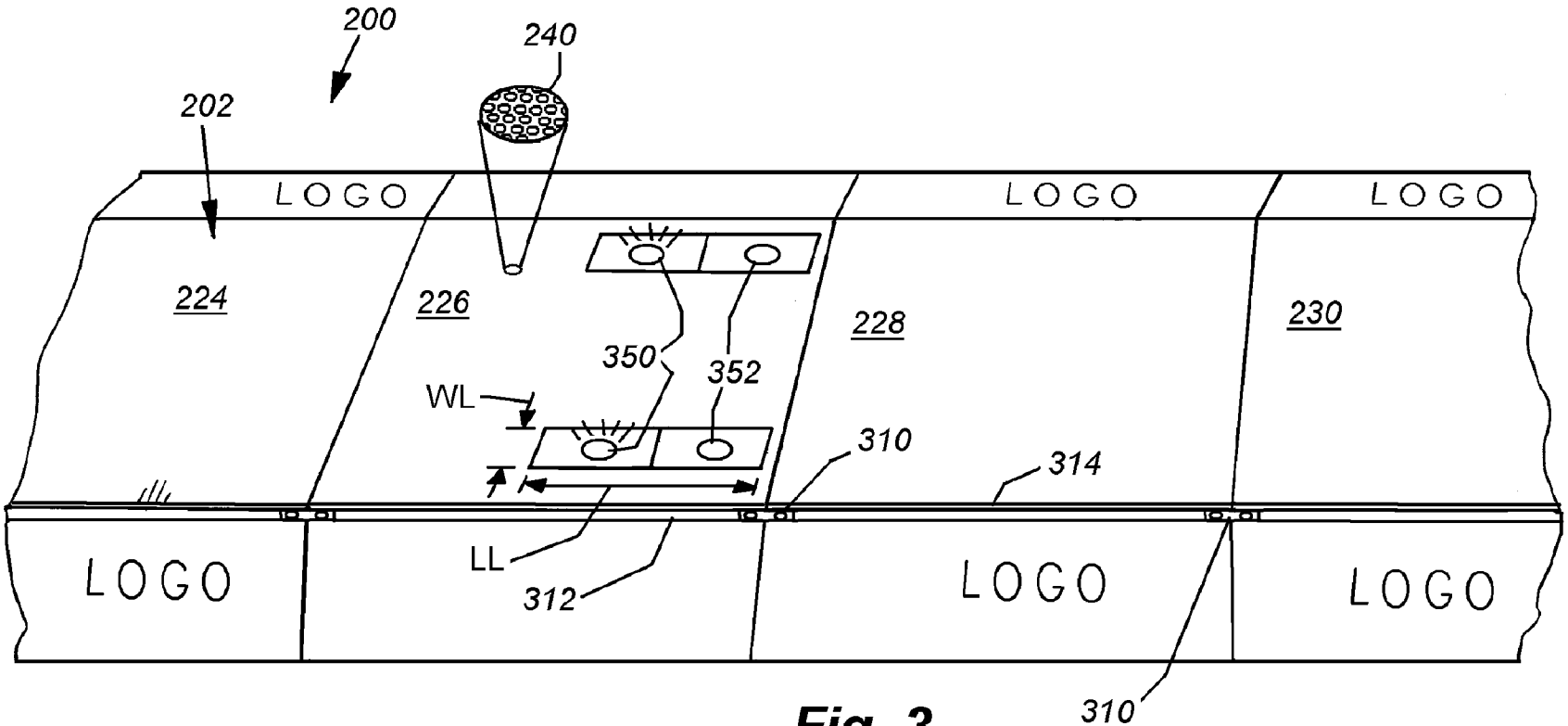
FIG. 3 is a more-detailed partial perspective view of the fencing strip of FIG. 2 showing placards and embedded scoring light assemblies according to the illustrative embodiment.
Figure 4:
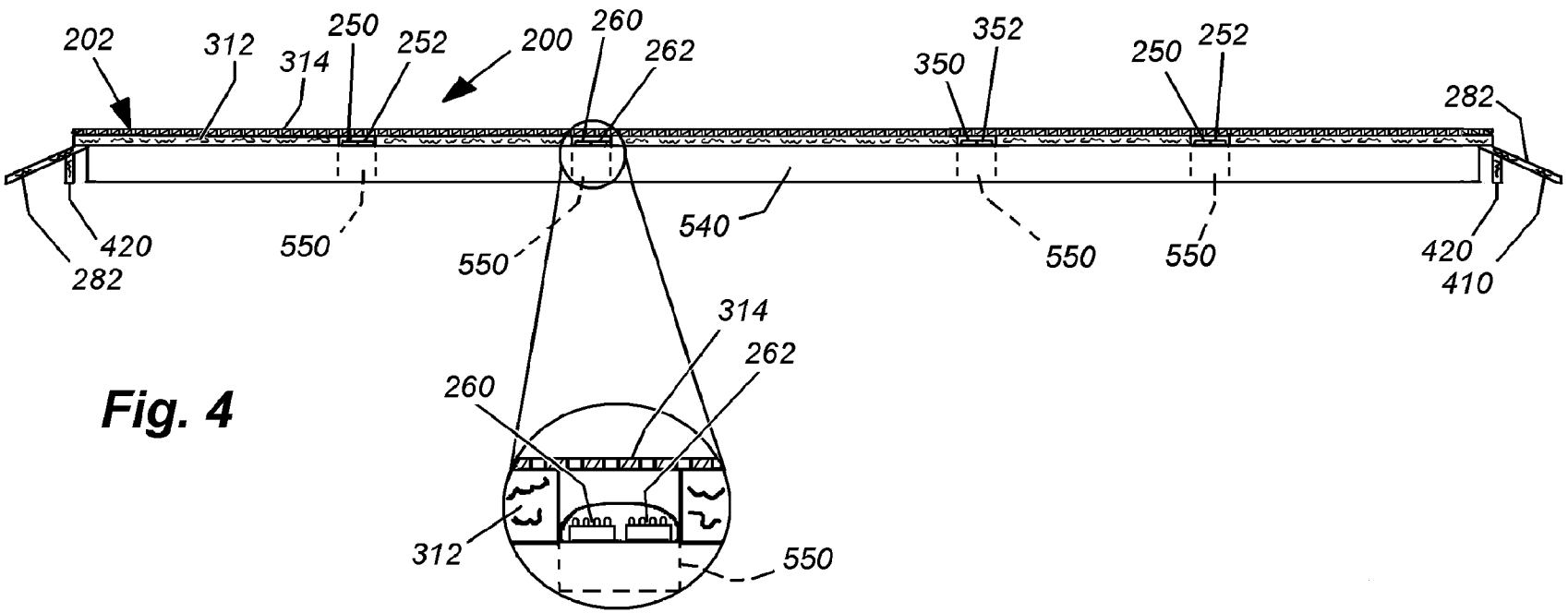
FIG. 4 is a side view of the fencing strip of FIG. 2 with placards removed to expose an outside support stringer.
Figure 5:
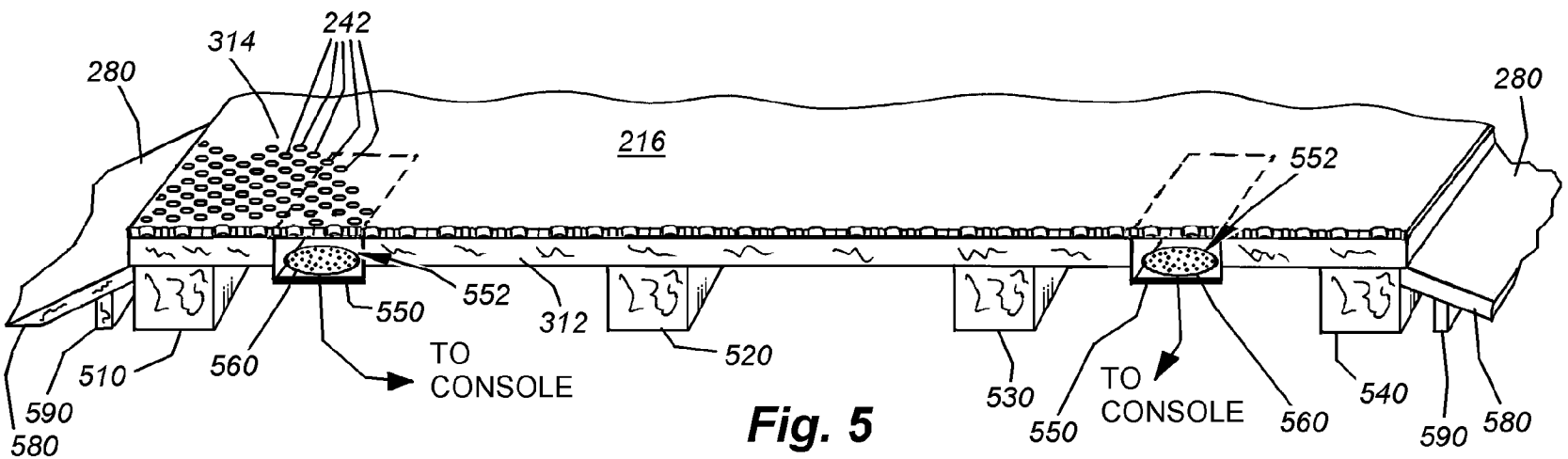
FIG. 5 is a widthwise cross section of the fencing strip of FIG. 2 taken through the scoring light assemblies.

As further described in FIG. 3, the adjoining strip segments (examples herein being 224, 226, 228 and 230 are shown in further detail joined together with appropriate clamps 310 attached between the joints on panels along the subsurface 312. The conductive, perforated top surface 314 is shown sandwiched together with the subsurface 312. The top surface and subsurface can be joined together using screws, adhesives or any acceptable fastening system, In general, the combination of melamine subsurface 312 and metal top surface 314 creates a laminate composite with relatively good durability and high strength. The sandwiched top surface and subsurface of each of the segments is supported on a set of stringers, as shown in FIGS. 4 and 5. The stringers 510, 520, 530 and 540 are spaced in a widthwise direction at approximately even intervals to evenly distribute the load on the top surface/subsurface. In this embodiment, there are four stringers, each 2-4 centimeters tall and approximately 4 centimeters in width. Thus, the overall height of each segment (and the resulting assembled strip) from the floor to top surface is approximately 5.5 centimeters. The stringers can be continuous, along all or part of the strip's length, or preferably, can be broken up and permanently adhered to the individual segment's subsurfaces. The stringers are positioned so as to allow wells or buckets 550 to be disposed within selected segments. With particular reference to FIGS. 4 and 5, the buckets 550 are mounted beneath rectangular slots 552 cut through the melamine subsurface 312. This allows the interior of each of the buckets 550 to be exposed directly to the underside of the conductive metal sheet surface 314. As such, the perforations 242 allow for a predetermined degree of optical communication between the outside environment and the interior of each bucket 550. Each of the buckets 550 contains one or more lighting elements 560. These lighting elements can be any acceptable light source including a high-output LED panel (as depicted in FIG. 5), incandescent bulbs, florescent or gas-discharge bulbs, or a combination of such light sources. The perforations 242 allow the light sources to be clearly viewed through the top surface 314 when they are lit.

Note that the use of stringers in then illustrative embodiment is at least in part to facilitate the mounting of light assemblies beneath the subsurface as described herein. Where light assemblies are constructed with particularly lowprofile light elements (such as certain types of LED panels), then the height of the stringers can be minimized, or they can be omitted entirely. However, as described below, the use of raised stringers facilitates the inclusion of downwardly, angles, information-containing placards, which may be beneficial for sponsorship and advertising purposes in certain embodiments to be described below.

Referring to FIG. 3, a pair of light sources 350 and 352 are disposed in a lengthwise-side-by-side relationship along. The light sources can both be mounted on a single segment as shown, or can be divided between two adjoining segments (for example panels 214 and 216). In this embodiment, the two separate light sources are each a different color. One color may be green and one color may be red (or any other color combination can be used). Referring to FIG. 2, in this embodiment the color green is represented by the letter G for each light and the color red represents the letter R for each light. As shown in FIG. 3, one set of light sources 350 have been lit, thereby allowing their light to be viewed through the perforations on the surface 314. Because the light buckets are relatively small in dimensions (for example, having a width WL of approximately 5-15 centimeters and a length LL of approximately 10-30 centimeters, the slot in the underlying subsurface melamine does not unduly compromise the structural integrity of the strip. In addition, the slots cut through the subsurface for these light buckets are located on or near the widthwise edges of the strip 202, thereby reducing the degree of contact with the fencers feet (since the fencers will tend to remain relatively centered on the strip). By providing slots in the subsurface while maintaining an unbroken, perforated top surface, no compromise of electrical contact occurs even though the lights are clearly visible therethrough.

It should be clear, the lights are designed to report the prevailing score with each light in a pair (350, 352, for example) representing a particular fencer. In this embodiment, and as shown in FIG. 2, four spaced-apart locations along the strip are chosen for the placement of light pairs. On each far end of the strip, a respective light pair 250 and 252 is provided. In addition, two light pairs (lights 350, 352 described above and lights 260, 262) are also provided closer to the center. The actual center of the strip continues to be served by the console itself.

It should also be clear that the number and placement of light pairs is highly variable. In this example similar lights are provided on each widthwise edge to afford a good view from either side of the strip. In alternate embodiments, lights can be centered on the strip or placed on only one side thereof. Likewise, a larger or greater number of lights can be mounted on the strip. For example, in one alternate embodiment, every segment may include a light assembly for standardization of components. Some may or may not be activated, depending upon the user's preferences. The light elements themselves are highly variable, as well. In an alternate embodiment, the light assemblies can take up less area on the strip by combining two colors in one light source. This can be achieved using a multi-color LED panel that can be controlled to project each of a plurality of different light colors. In addition, as shown in the magnified view of FIG. 4, the light elements can be covered by a clear dome. This dome can include two different colored filters so a single color (white) light can be projected in the appropriate color. In this manner two white sources can be used and they appear either green (or blue) or red (or yellow) due to the effects of the translucent filter mounted over the light.

Figure 6:
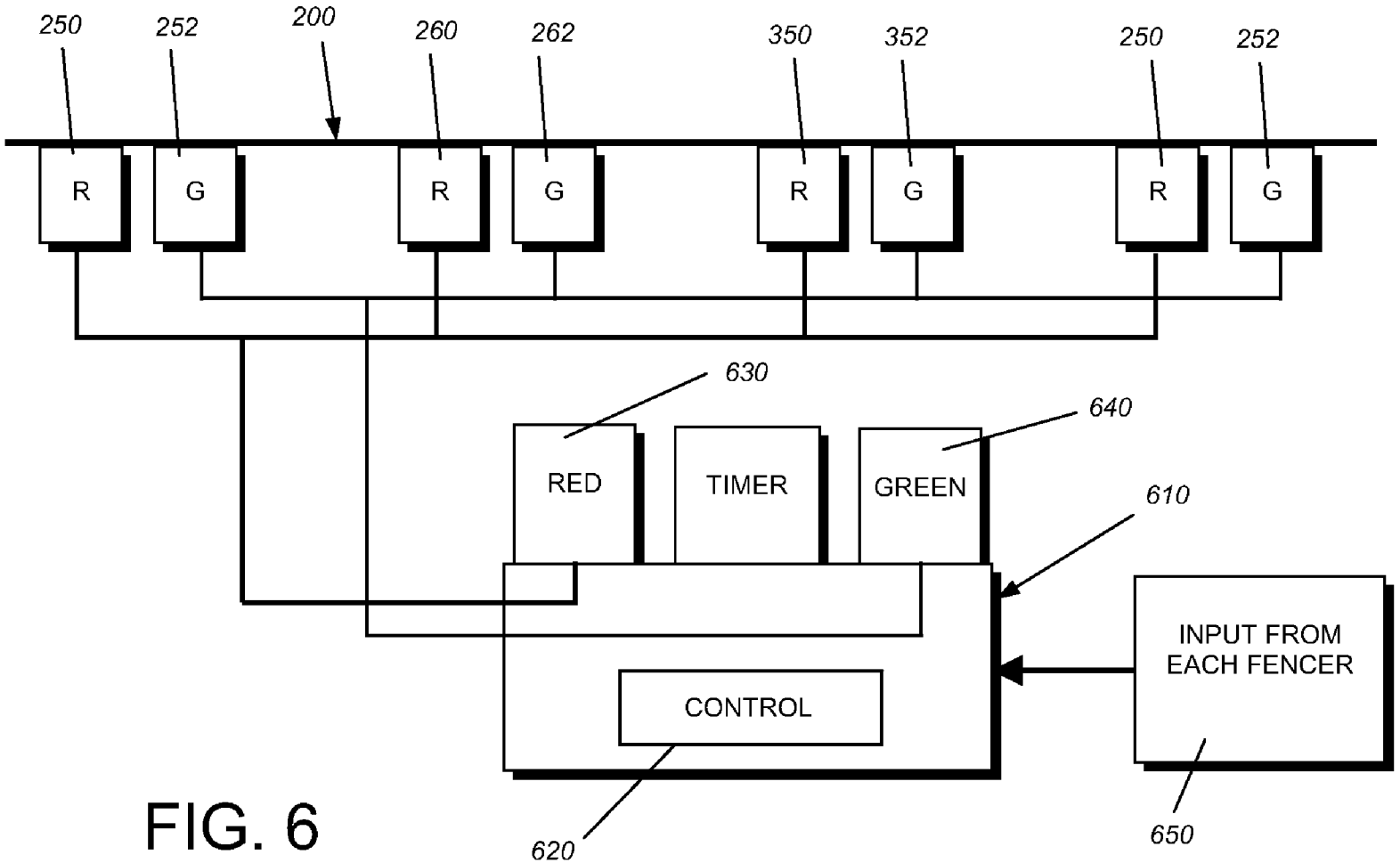
FIG. 6 is a schematic block diagram showing the interconnection of the control and scoring console with the embedded scoring light assemblies located along the length of the illustrative fencing strip in accordance with an embodiment of this invention.

Control of the embedded scoring lights is relatively straightforward. As shown in FIG. 6, the score console 610 includes a control block 620 that provides either a red or green scoring light 630 or 640 respectively based upon he relative input from each fencer 650. The red scoring light 630 is connected in parallel with each red light 250, 260 and 350 embedded in the fencing strip 202. Likewise, the green scoring light 640 is connected in parallel with each green light 252, 262 and 352 embedded in the strip 202. Appropriate amplifiers, voltage-reduction circuits and other needed switching circuitry, and/or voltage/current handling functions can be implemented in the control block 620 as appropriate. The control block, and/or any of these circuits can be housed in the console 610, provided within the buckets for each light source or some combination of these placements.

Having described the novel embedded scoring light arrangement for the illustrative fencing strip 200, reference is now made again generally to FIGS. 2-5, where a novel arrangement of information-containing placard 280, 282 is now be described in further detail. The placards 280 are located along the lengthwise edges of the central strip 202 while two end placards 282 are located on opposing ends of the strip 202. In this embodiment, the placards comprise ramps that can include appropriate trademark, advertising, promotional or public interest information (symbolized generally by the term "LOGO" and/or "NAME". The placards can be preprinted with such information or can receive appropriate removable cards, using conventional framing techniques or self-adhesive decals. It should be noted that the inventive placard arrangement described herein clearly provides a new and useful form of advertising and sponsorship revenue for fencing events and athletic programs. The placards 280, 282 also naturally render the appearance of the strip 200 more aesthetic covering the outer stringers 510, 514 (FIG. 3) and rendering the overall appearance of the strip more streamlined, and grounded to the floor.

As shown more particularly in FIGS. 4 and 5, each placard 282, 280 defines a durable top surface 410, 580 (respectively), constructed from a durable fibrous material, polymer or other sheet-like material. Each placard's top surface 410, 580 extends outwardly and downwardly from the strip at an approximate angle of 5-20 degrees with respect to the ground. The placard surface 410, 580 contains sufficient area to provide highly visible information. As shown the length of each placard matches that of the segment. In the case of lengthwise placards 280, that length is approximately 122 centimeters. The end placards 282 are more than 150 centimeters—owing to the width of the internal strip portion 202. The widthwise dimension of placards (i.e. how far they extend away from the strip edge) is highly variable. In one embodiment, this widthwise extension is between approximately 20 and 40 centimeters, but the actual dimension is highly variable. As particularly detailed in the cross section of FIG. 5, the inward-directed ends of each placard (placards 280 being shown) pass under an overhanging of subsurface 312 and conductive top surface 314 that extends past the adjacent outer stringer 510 and 540. This arrangement provides a clean appearance at the transition between the strip interior 202 (the flat portion that is stood upon), and the outwardly extending placards. A similar overhang is shown at the lengthwise ends of the strip in FIG. 4 with the end placards 282 passing thereunder. A variety of other techniques for securing or engaging the edges of the strip are also contemplated. In an alternate embodiment, the placards can be constructed so that they mate somewhat flushly against the top surface 314 of the strip interior 202. To maintain the chosen upward angle relative to the floor surface, each placard 282, 280 includes a small post member 420 and 590 (respectively), which allows it to maintain the upward angle. The post member 420, 590 is located along the width of each placard at a location that insures it will remain firmly engaged against the overhanging lip of the subsurface 312 and top surface 314. Hook-and-loop fasteners, magnets, or other removable fastening mechanisms (not shown) can also be used conventionally between the inward-directed ends of the placards and the strip interior 202 to further secure each placard to the lip if desired. In this embodiment, the placards are sized to match the length of each strip segment. In alternate embodiments, longer placards can be used with fewer breaks therebetween.

The foregoing has been a detailed description of illustrative embodiments of the invention. Various modifications and additions can be made without departing from the spirit and scope if this invention. Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. For example, the size, shape and elevation the fencing strip of this invention is highly variable. In alternate embodiments, the strip may not need to be conductive, and light assemblies can be embedded therein using transparent windows that sit flush with the surrounding strip top surface. Likewise, in any of the embodiments herein, additional light colors or effects (e.g. flashing lights) can be used in conjunction with the embedded light assemblies described herein. In one example, lights can be made to flash for certain types of fouls, or additional lights in additional colors can be used to indicate fouls, certain types of touches or timeout. Using multi-color light arrays, these various colors can be accommodated without increasing the size of the light assembly's footprint within the strip. Accordingly, this description is meant to be taken only by way of example, and not to otherwise limit the scope of this invention.

What is claimed is:

1. A fencing strip disposed on a floor surface and for support of contestants engaged in a fencing match, said fencing strip having a length and width and comprising:

a planar subsurface;

an electrically conductive top surface having a plurality of adjacent perforations that allow for transmission of light therethrough;

the electrically conductive top surface being interconnected with an electronic scoring system;

the electrically conductive top surface and the planar subsurface being sandwiched together;

a set of stringers including respective opposed side stringers and at least one more intermediately disposed stringer;

the stringers extending in parallel to each other along the length direction of the fencing strip and for support of the sandwiched electrically conductive top surface and planar subsurface;

a plurality of light sources, each being constructed and arranged to indicate each of a plurality of different scoring events, the light sources each being located beneath the conductive top surface and between adjacent stringers; and a plurality of wells with each well for retaining a corresponding light source;

each said well formed at a slot in the planar subsurface that enables light from the light source to be directed up through the slot so that light from the light source projects through, and is viewed through, at least some of the plurality of adjacent perforations of the conductive top surface, the light sources being interconnected with a scoring control of the electronic scoring system.

2. The fencing strip as set forth in claim 1 wherein the slots each have a section of perforated top surface disposed thereover, and each well comprises an enclosure for the light source that has an open top to enable the light from the light source to be communicated to and through the perforations.

3. The fencing strip as set forth in claim 1 wherein each of the light sources is located at positions on each of opposing widthwise sides of the fencing strip and the positions are located at a plurality of predetermined lengthwise spacings along a length of the fencing strip.

4. The fencing strip as set forth in claim 1 wherein the fencing strip defines a plurality of strip segments each mounted on stringers and being interconnected by connectors.

5. The fencing strip as set forth in claim 1 wherein the well is defined at least in part by sidewalls of the slot formed in the subsurface.

6. The fencing strip as set forth in claim 1 wherein the perforations extend across the width of the electrically conductive top surface.

7. The fencing strip as set forth in claim 1 wherein the light sources are disposed closer to respective opposed side stringers than the at least one more intermediately disposed stringer.

8. The fencing strip as set forth in claim 3 wherein the light sources are constructed and arranged to project at least two different colors corresponding to at least two different scoring events.

9. The fencing strip as set forth in claim 8 wherein the light sources include at least two different color light assemblies mounted side-by-side relationship.

10. The fencing strip as set forth in claim 4 further comprising a plurality of placards located along outer edges of the fencing strip and containing information thereon, and wherein inward-directed ends of the placards engage the stringers.

11. The fencing strip as set forth in claim 10 wherein the placards extend from outer edges adjacent to a floor surface toward the stringers at an upward angle.

12. The fencing strip as set forth in claim 11 wherein the inward-directed ends of the placards extend beneath an overhanging lip defined between the subsurface and the stringers.

13. The fencing strip as set forth in claim 6 wherein the diameter of each perforation is on the same order of magnitude as the spacing between adjacent perforations.

14. The fencing strip as set forth in claim 7 wherein the stringers include two more intermediately disposed stringers.

15. The fencing strip as set forth in claim 14 wherein the light sources are disposed only adjacent to the respective side disposed stringers and not between the two or more intermediately disposed stringers.

* * * * *